United States Patent [19]

Kuroda et al.

[11] 4,339,684

[45] Jul. 13, 1982

[54] ELECTRON MULTIPLIER TUBE WITH AXIAL MAGNETIC FIELD

[75] Inventors: Kei-ichi Kuroda; Daniel Sillou, both of Geneva, Switzerland; Fujio Takeutchi, Pittsburgh, Pa.

[73] Assignee: ANVAR, France

[21] Appl. No.: 104,818

[22] Filed: Dec. 18, 1979

[30] Foreign Application Priority Data

Dec. 22, 1978 [FR] France ..... 78 36148

[51] Int. Cl.[3] ..... H01J 43/18; H01J 43/14

[52] U.S. Cl. ..... 313/105 R; 313/162

[58] Field of Search ..... 313/104, 105, 162

[56] References Cited

U.S. PATENT DOCUMENTS

| | | | |
|---|---|---|---|
| 2,115,155 | 4/1938 | Banks | 313/162 X |
| 2,160,798 | 5/1939 | Teal | 313/105 |
| 2,196,278 | 4/1940 | Teal | 313/105 |
| 2,249,016 | 7/1941 | Lubszynski | 313/105 |
| 2,254,617 | 9/1941 | McGee | 313/105 X |
| 2,305,179 | 12/1942 | Lubszynski et al. | 313/105 X |
| 3,027,478 | 3/1962 | Cassman et al. | 313/105 X |
| 3,119,037 | 1/1964 | Stanley | 313/105 X |
| 3,191,086 | 6/1965 | Gebel | 313/103 X |
| 3,872,337 | 3/1975 | Davis et al. | 313/105 X |

*Primary Examiner*—Palmer C. Demeo

*Attorney, Agent, or Firm*—Thomas J. Greer, Jr.

[57] ABSTRACT

Electron multiplier tube, comprising along the principal axis an electron-emitting surface, several dynode stages with distributed structure, capable of reflux secondary electron emission, and an electron-receiving surface, as well as means producing an electron-accelerating electric field generally oriented along the principal axis, from the electron-emitting surface to the electron-receiving surface. With it is associated coil means producing a magnetic field generally oriented along the principal axis of the tube.

Particular example is a photomultiplier with high spatial resolution.

14 Claims, 8 Drawing Figures

ELECTRON MULTIPLIER TUBE WITH AXIAL MAGNETIC FIELD

The present invention concerns electron multipliers, and more particularly photomultiplier tubes.

It is known that electron multiplier tubes conventionally comprise, in an evacuated chamber, firstly one or several electrodes forming a directional cathode and source of electrons, then a series of electrodes capable of secondary emission of electrons, or dynodes, and lastly an anode constituting an electron collector. These various electrodes are arranged along the principal axis of the tube; in operation, they are subjected to suitable voltages for creating an electric field to accelerate electrons along this same axis. In photomultipliers, the electron source, of photosensitive material, is called a "photocathode".

Several dynode structures are known. In one type of electron multiplier, ("box-type"), each dynode is comprised of a single element, and the dynodes together define a sort of box channelling the electrons, each dynode partly facing the preceding one and partly the next one.

In other electron multipliers, each dynode has a distributed structure comprising several active elements (ensuring secondary emission), which extend transversally to the principal axis of the tube. For example, each dynode is constituted of rectangular plates parallel to each other, whose large side extends perpendicularly to the principal axis of the tube while their short side is inclined to this same axis. By analogy, such dynodes are called "Venetian", or "shutter"-type. Two consecutive dynodes often present an inclination which is alternated and symmetric with respect to the principal axis of the tube.

Electron multipliers called multi-channel multipliers are also known, in which the electrons arriving at the anode are distinguished according to the point of the cathode in which they have been generated. These multi-channel arrangements thus present several associated anodes provided with as many electrical connections. They have various sorts of dynode structure.

Although they function in an acceptable way, these multi-channel electron multipliers generally suffer from a poor spatial resolution: they only distinguish some regions of electron impact, well delimited, at the cathode level. In fact, they do not allow a real general correspondence to be established between the impact of an electron on the cathode and the impact on the anode of electrons consequently multiplied by the dynodes.

It is an object of the invention to provide an electron multiplier capable of such a correspondence, which will be hereinafter called "locating".

SUMMARY OF THE INVENTION

Hitherto, magnetic fields have been considered to have a very bad effect in electron multipliers the inventors have now observed, however, that by applying to an electron multiplier equipped with dynodes with distributed structure a magnetic field oriented along its principal axis, a far better spatial resolution can be obtained at the same time as maintaining satisfactory working characteristics, and further research has shown that spatial resolution, gain characteristics, and time resolution improve when the size of the active elements is decreased in the plane of secondary emission constituted by the dynodes, while increasing the electric and magnetic fields.

The multiplier tube proposed is consequently of the type comprising, along a principal axis, a surface for emitting electrons, several stages of dynodes with distributed structure, and capable of reflex secondary electron emission, an electron-receiving surface, and means for producing an electron-accelerating electric field generally oriented along the principal axis from the electron-emitting surface to the electron-receiving surface.

According to the invention, a magnetic field is generally oriented along the principal axis.

By a dynode with distributed structure and capable of reflex secondary electron emission is meant a dynode with a discontinuous surface capable of secondary emission and arranged to emit secondary electrons from the side at which the primary electron arrives.

The dynodes advantageously comprise series of or grids of elongate elements or bars, which are prismatic or cylindrical, and parallel each grid being substantially perpendicular to the principal axis of the tube. Although such a grid in itself offers no possibility of effecting a locating of electrons along its large dimension, a nearly uniform spatial resolution in all directions perpendicular to the principal axis of the tube occurs. It is also very advantageous to divide each dynode stage into several lengths or sub-stages, which are displaced from each other so that the assembly of the various sub-stages constituting a dynode appears to the incident electrons as a practically opaque surface.

The small dimensions of the bars in the plane perpendicular to the principal axis is preferably less than about 1 mm, and the space between two adjacent bars is at least equal to their small dimension. This improves both the spatial resolution and the gain. It is consequently desirable, although not absolutely necessary, for the electric field to be more than 200 V/cm and for the magnetic field to be more than 50 Gauss. In the preferred embodiments of the invention, the small dimensions of the bars is about 0.5 mm, and the electric field and the magnetic fields are selected correlatively to each other between about 400 and 1,000 V/cm, and between about 100 and 500 Gauss, respectively.

In a first particular embodiment, each dynode comprises two grids of bars spaced along the principal axis; in each grid the bars are spaced by a distance equal to their small dimension; the two grids are displaced in relation to each other by a distance equal to their small dimension; and the electric and magnetic fields are correlatively selected so that a secondary electron emitted by one bar of the first grid still passes statistically between the bars of the second grid, the word "statistically" here meaning that a secondary electron still retains a certain—very low—probability of reaching the bars of the second grid.

In another particular embodiment, each dynode comprises n grids of bars spaced along the principal axis; in each grid the bars are spaced by n times their small dimension; the n grids are successively displaced, each with respect to the previous one, in the same direction by a distance equal to their small dimension; and the electric and magnetic fields are correlatively selected so that a secondary electron emitted by one bar of one grid on a parallel to the principal axis passes statistically on the same parallel substantially to the levels of the next grid and the n-th grid.

This second structure works particularly well for n+5.

It is also advantageous for the bars to have a cross-section which is symmetrical with respect to a plane parallel to the principal axis and passes through the axis of their larger dimension. This provides a greater uniformity of the electric field, and improves spatial resolution.

In practice, the cross-section of the bars is of the right-angled isosceles triangle type with the hypotenuse directed towards the down-side of the electron paths, of the circular type, or of the flat rectangular type with predetermined inclination to the principal axis, the bars then being plates. But other types of cross-section can be envisaged.

The principal application studied has been that of photomultipliers, but the invention generally applies to all types of electron multiplier tube whose dynodes, with distributed structure, are capable of reflex secondary emission. The electron-emitting and -receiving surfaces which enclose these dynodes can have various shapes.

The electron-emitting surface can thus be an electron-emissive electrode, cathode or photocathode, or a surface which is transparent to electrons of external origin. The electron-receiving surface itself can be a divided anode with multiple connections, an electroluminescent surface or a mosaic surface analysable by electron beam, as will be seen hereinafter.

Other objects and advantages of the invention will appear from reading the detailed description which follows, with reference to the accompanying drawings.

DETAILED DESCRIPTION OF THE PREFERRED EMBODIMENTS

Although the apparatus which will be described hereinafter involves a photomultiplier, its characteristics are applicable to all types of electron multiplier tube, the behaviour of the electrons being substantially the same, whatever their origin.

Figure 1:
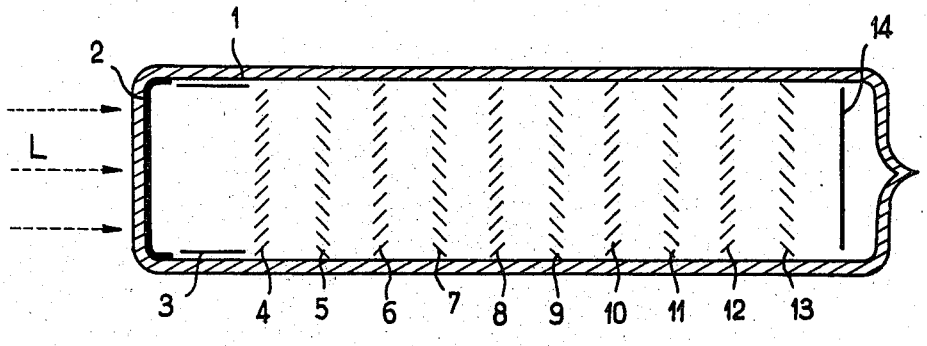
FIG 1 PRIOR ART
FIG. 1 is a simplified section of a conventional photomultiplier with Venetian dynodes.

FIG. 1 is a diagrammatic view in section of a conventional photomultiplier tube with Venetian dynodes. In an evacuated glass tube 1, a photocathode 2 is arranged to receive a beam of light L. Of photoelectric material, this cathode reacts to each photon by emitting a primary electron, channelled by an electrode 3. The primary electrons are directed towards a series of 10 dynodes, with reference numbers 4 to 13, and followed by an anode 14. The assembly of electrodes is biased by voltages suitable for creating an electric field which accelerates the electrons from the cathode towards the principal anode-axis of the tube.

Each dynode, with distributed structure, comprises a plurality of parallel inclined plates which extend perpendicularly to the plane of FIG. 1, and are disposed vertically in the plane of FIG. 1. For example, in one embodiment, the plates are rectangular, 30 mm long and 3 mm wide; their small side is inclined at 45° to the principal axis of the tube; the direction of inclination alternating from one dynode to another.

The surface of the dynodes is made of material capable of secondary electron emission, that is to say that, when struck by an electron, each dynode emits several secondary electrons from the side at which the primary electron arrives. And the secondary electrons are in their turn accelerated and directed by the electric field towards the next dynode.

Figure 2:
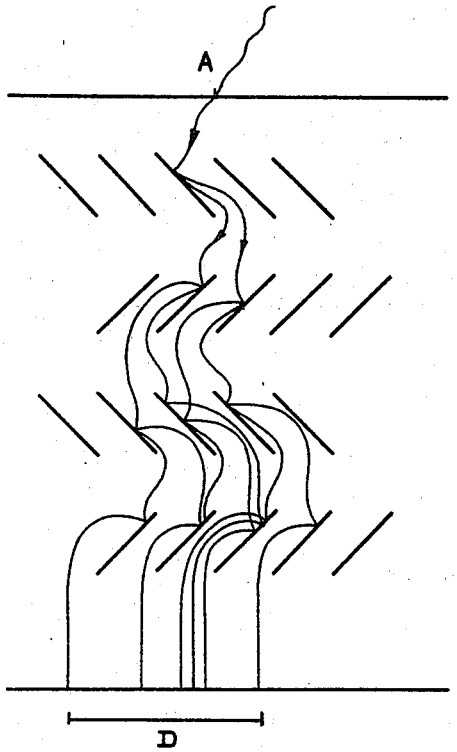
FIG 2 PRIOR ART
FIG. 2 is a very diagrammatic section illustrating the electron paths in a conventional photomultiplier.

FIG. 2 illustrates this process very diagrammatically and shows how, for a photon arriving at A on the photocathode, the anode receives electrons over quite a large surface marked D.

Until now, magnetic fields have been considered to be very bad for the qualities essential in a photomultiplier tube, which are, the gain (electron multiplier factor), with its linearity and uniformity, as well as time resolution, meaning the minimum time interval required between two primary electrons for the anode of the tube to produce distinct signals. In particular, the tubes are very often carefully protected from magnetic fields with the aid of a screen of mu metal.

Figure 3:
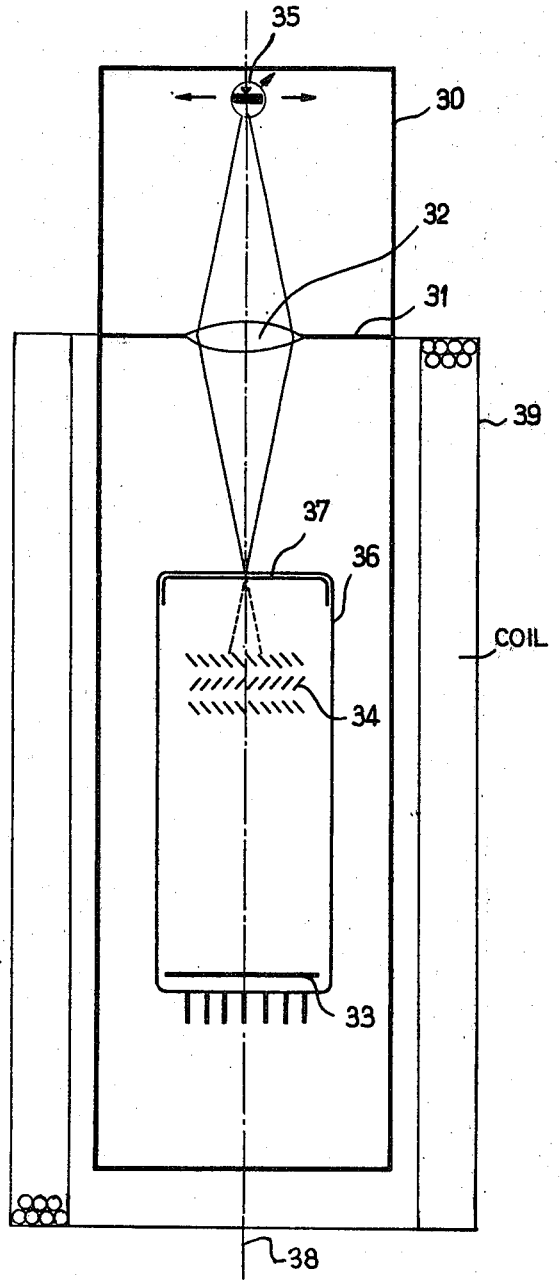
FIG. 3 is a view in section of an experimental apparatus including a photomultiplier tube subjected to an axial magnetic field.

Nevertheless, the inventors decided to study the effects of magnetic fields more specifically, with the aid of the experimental apparatus of FIG. 3. A dark chamber 30 comprises an inner partition 31 in which a converging lens 32 is mounted. A photodiode (LED) 35 (0.5 mm point source) and a photomultiplier tube 36 are housed in the chamber either side of this. The photodiode is movable in a plane which is the conjugate plane, with respect to the lens, of the plane of the photocathode 37 of the tube 36. The point image of the photodiode is thus able to sweep the whole surface of the photocathode. The tube comprises several dynode stages 34 and an anode 33.

The tube 36 is the EMI 6262, for example, conventionally biased with a high voltage of 1,500 Volts. Lastly, a coil 39 produces a magnetic field oriented along the principal axis 38 of the tube, for example downwards (the direction of the magnetic field has proved to be of little importance until now).

Figure 4:
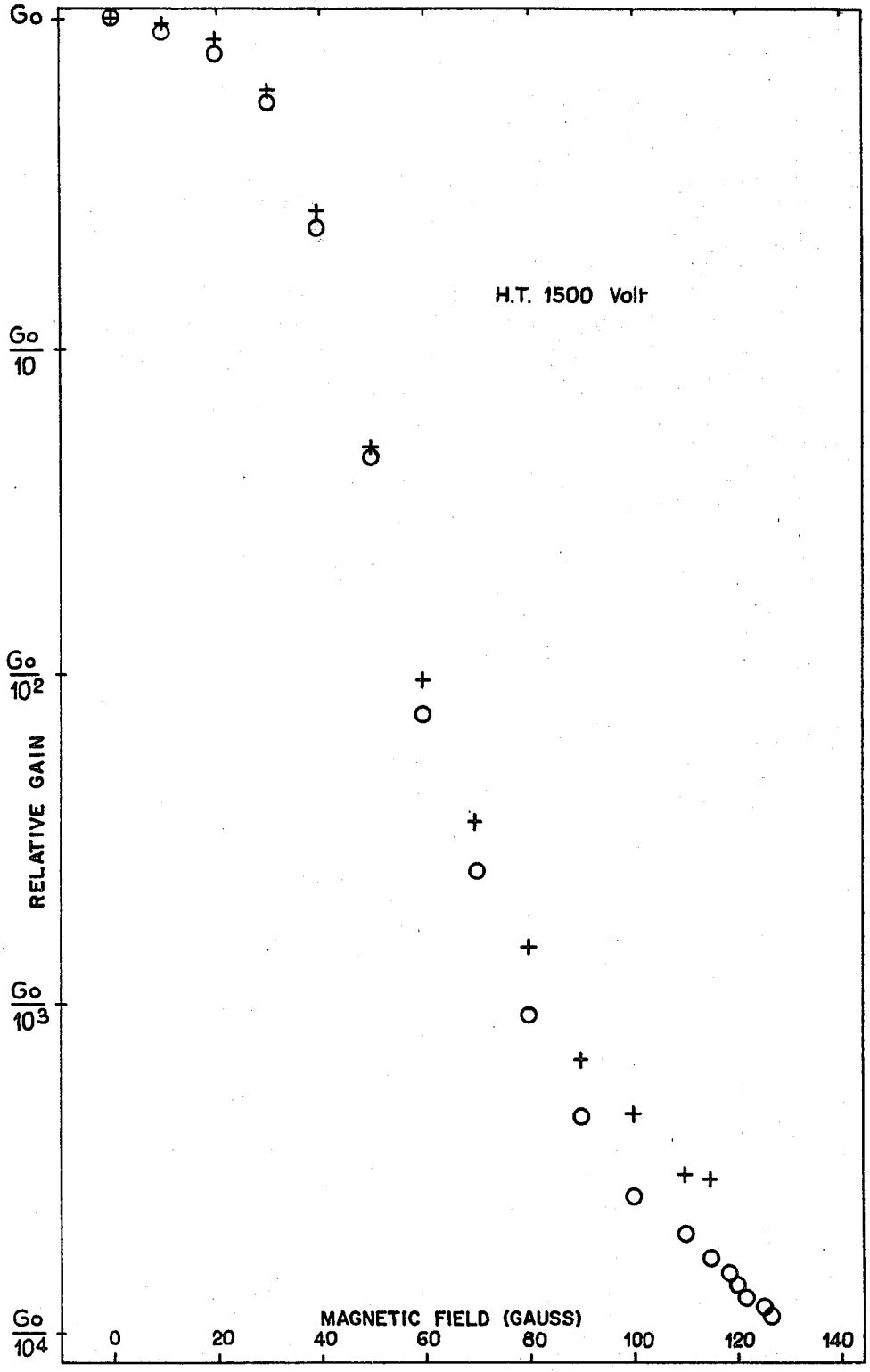
FIGS. 4 and 5 are diagrams relating to the experimental apparatus of FIG. 3, and FIGS. 6 to 8 are diagrams in isometric projection illustrating various geometrics of dynodes usable according to the present invention.

FIG. 4 illustrates the output signal of the tube as ordinate on a logarithmic scale, as a function of the magnetic field applied, plotted linearly as abscissa. For each value of the field, the photodiode has been placed in two positions corresponding to the two edges of one of the plates constituting the dynodes. The points marked "+" and "o" correspond respectively to the upper and lower edges of the plate.

At zero magnetic field, the two points merge, and the gain is $G_O$; as the magnetic field increases, the gain decreases, and the two points "+" and "o" increasingly separate. One notes the rapid fall in the gain above B=30 Gauss, whereas below this value, the gain remains substantially constant. The inventors have estimated that the value of 30 Gauss corresponds to a radius of curvature of electron paths in the magnetic field of the order of magnitude of the width of the plates (3 mm). When the field B exceeds 30 Gauss, the radius of curvature of the path of a secondary electron emitted by a dynode is small, and the electron has a large chance of being recaptured by the plate, hence the rapid diminution in the gain with the magnetic field. Conversely, when the field B is less than 30 Gauss, the electron has the greatest chance of arriving at the next dynode, hence the substantially constant gain.

Figure 5:
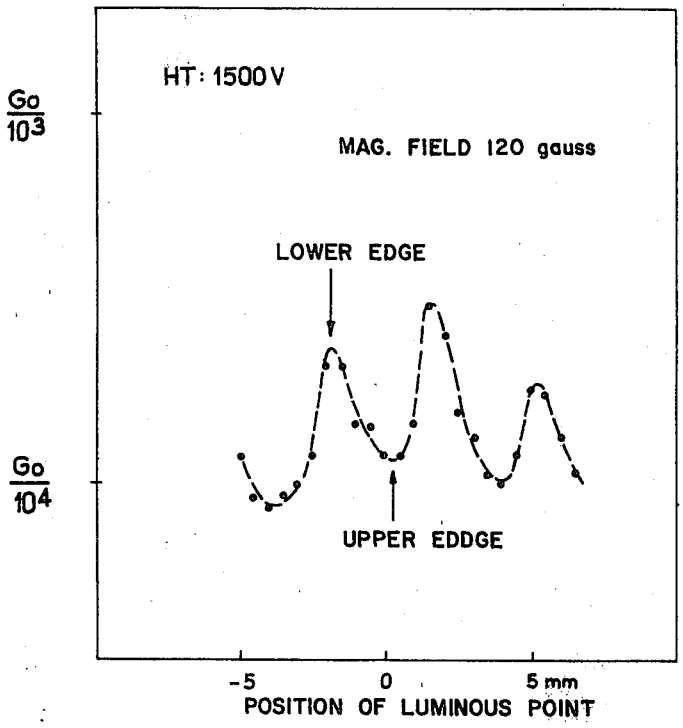

FIG. 5 illustrates, for a magnetic field of 120 Gauss, the output signal of the tube plotted as ordinate on a logarithmic scale, as a function of the position of the luminous point on the cathode, plotted linearly as abscissa. This figure shows that the gain varies as a function of the position of the light source, and that the trend of the gain reflects the plate structure of the dynodes.

This confirms the part played by the radius of curvature of the electron paths, because a secondary electron emitted near the upper edge of a plate has a greater chance of being recaptured by the latter than the secondary electron emitted near the lower edge.

The inventors have also observed a channelling of electron paths around the axis of the field B. Returning to FIG. 3, the larger the field B, the smaller the area D becomes. This again is due to the radius of curvature imposed on electron paths by the magnetic field. It is hence possible to locate the origin A of the primary electron at the level of the anode, by using, for example, a divided anode or multi-anode.

The locating effect due to the magnetic field is achieved with the aid of the electron multiplier tube arranged according to FIG. 3. In fact, this tube retains actual multiplying properties, despite a gain lower than the value $G_O$ for zero field.

The experimental results shown in FIGS. 4 and 5 demonstrate that the gain can be improved by reducing the width of the plates according to the radius of curvature imposed on the electron paths by the magnetic field.

More extended research has been made in this area, with the aid particularly of a simulation of the phenomena occurring in a photomultiplier tube with Venetian diodes such as that in FIG. 1.

Carried out on computer with the aid of a Monte Carlo program, the simulation took into account the geometric configuration of the tube, the value of the voltages between electrodes, experimental data on the secondary emission from the dynodes, as well as secondary effects such as loss at the edges and space charge.

With the electric field thus well established as well as the secondary emission, the effects of the magnetic field on the electron paths could be studied.

The simulation and its experimental verifications allowed several particular structures of dynodes to be arrived at which provide good locating as well as an improved gain.

Figure 7:
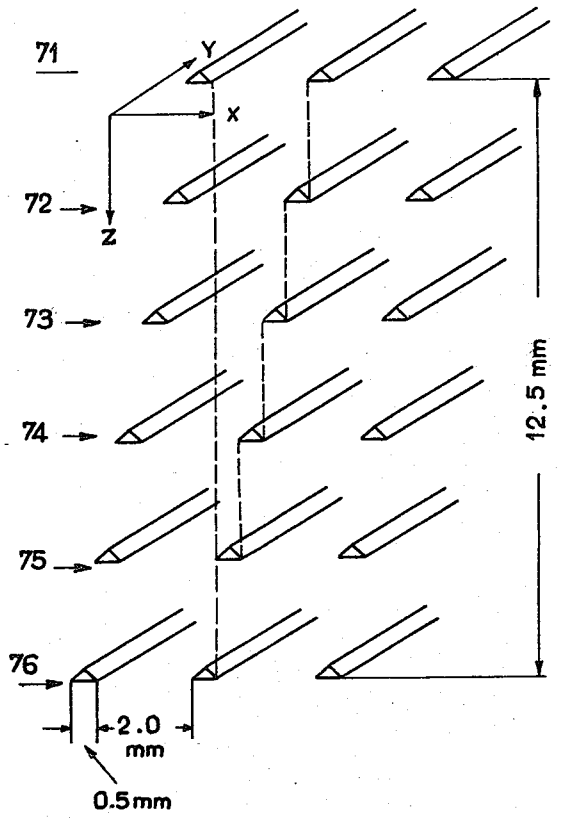
Figure 6:
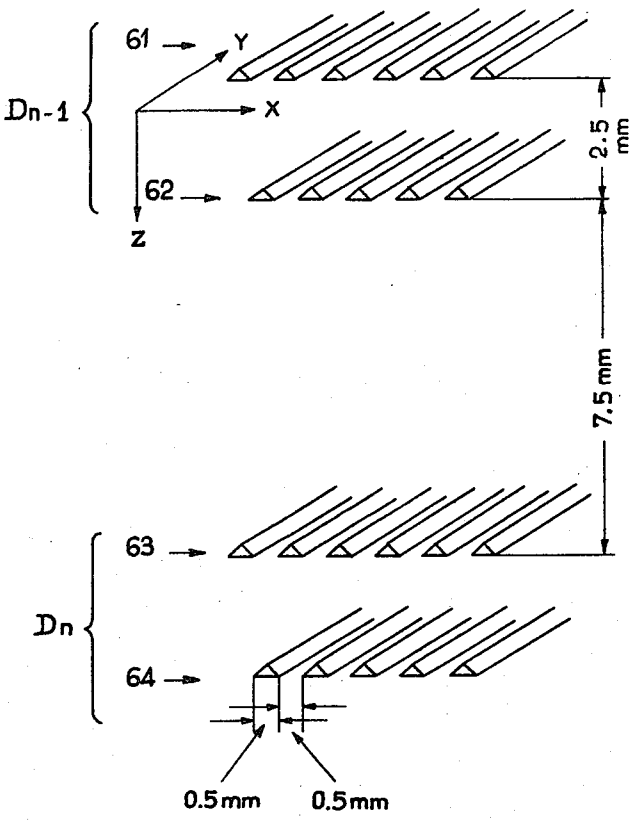

FIG. 6 illustrates the first of these structures, at present considered to be preferred. Each dynode here comprises two levels. Thus the dynode $D_{n-1}$ comprises the levels 61 and 62. The level 61 comprises a series of plates or rather elongate bars whose section is a right-angled isosceles triangle with a base of 0.5 mm. The base is perpendicular to the principal axis of the tube, and exposed to the next dynode. The free space between the apices at the bases of the two adjacent bars is also 0.5 mm. The second level 62, set at 2.5 mm from the first, is constituted in the same way, but its bars are aligned with the free spaces between those of the preceding stage, so that, seen from above, the assembly of the dynode constitutes a structure without free space. Such an arrangement between the bar elements 61 and 62 of dynode stage $D_{n-1}$, as well as the similar arrangement between bar elements 63 and 64 in the succeeding dynode stage $D_n$, is termed an impervious type of dynode stage. The same term, i.e., impervious, is applied to the arrangement or stages of FIGS. 7 and 8, as will presently be apparent from their manner of staggering so as to constitute a structure without free space vis-a-vis the passage of electrons in a straight line from one end of the apparatus to the other parallel to the longitudinal axis of the apparatus. The second dynode $D_n$ is similar to the first, its first level 63 being displaced by 10 mm with respect to the level 61. Lastly, the active surfaces on the plane of the secondary electron emission are at each level the two surfaces inclined at 45°, defined by the sides of the right angle of the right-angled isosceles triangle. A voltage of 150 Volts is established between the levels 61 and 62, a voltage of 600 Volts between the stages 61 and 63, and a voltage of 150 Volts between the stages 63 and 64, bias being thus repeated periodically for the assembly of dynodes. With 14 dynodes (each with two levels), an electric field of 600 Volts/cm and a magnetic field of 400 Gauss, such an electron multiplier is capable of achieving a spatial resolution (at middle level) of ±1.5 mm for a gain of the order of $10^7$. Another structure, considered less advantageous because it is more complex, is illustrated in FIG. 7. The idea of separated dynodes applies less in this structure, because the assembly of dynodes is constituted by a great number of equidistant levels, such as 71 to 76 which represent one part of it. Each level comprises bars identical to those in FIG. 6, but separated by a free space of 2.0 mm. The bars of one given level are displaced by 0.5 mm with respect to those of the preceding level, leftwards, for example. The second bar of the level 76 thus occurs at the vertical position of the first bar of the level 71, from the left. The assembly of the levels 71 to 75 forms an opaque system for a beam of electrons parallel to the z axis. Although the structure is regular along the axis Oz, one dynode stage can therefore be considered to correspond to 5 grids or consecutive levels, such as 71 to 75. The step between stages is 12.5 mm. With 14 stages, a magnetic field of 410 Gauss, and a voltage increasing by 400 Volts per stage, (say, an electric field of about 400 Volts/cm), such as electron multiplier is capable of achieving a spatial resolution (at middle level of the distribution of impacts on the anode) of ±1.5 mm, for a gain of the order of $10^7$.

The inventors have observed that in general the dynode structures whose bars have a symmetrical section with respect to the z axis are advantageous since they achieve a greater uniformity of the electric field, and thereby a better spatial resolution. In this connection, the bars with cross-section in the form of a right-angled isosceles triangle can, of course, be replaced with equivalent bars, for example with circular section and diameter nearly the size of the base or hypotenuse of the isosceles triangle, made capable of secondary emission at least at their upper part.

Figure 8:
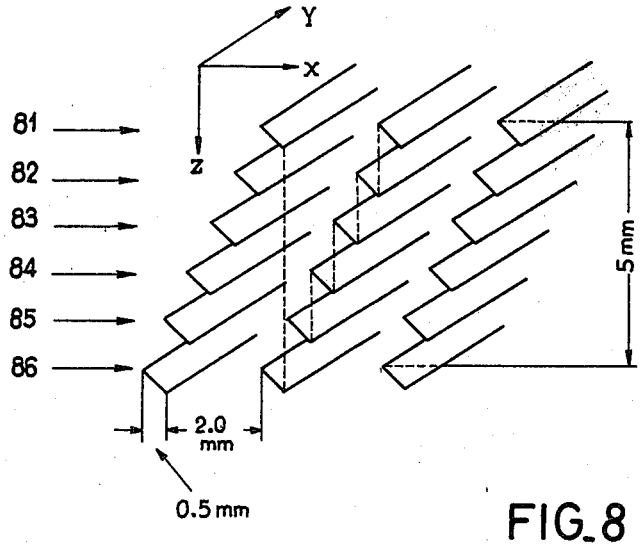

Another dynode structure is illustrated in FIG. 8. Like that of FIG. 7, it presents the levels 81 to 86 of active elements regularly distributed along the axis Oz, and displaced successively by a value equal to the small dimension of these active elements, projected on the x axis (0.5 mm); here again, the free space between two active elements is 2.0 mm, so that the active elements of the level 86 occur at the vertical position of those of the level 81. But this time, instead of bars of triangular section, the active elements are Venetian plates, all with the same side inclined at 45°, and of which only the face oriented upwards is capable of secondary emission. One stage is here again constituted of 5 adjacent levels of plates, and the step between stages is 5 mm. With 14 stages, a voltage between stages of 300 Volts (say, an electric field of 600 Volts/cm and a magnetic field of 230 Gauss, the spatial resolution at middle level is ±2 mm, and the gain of the order of $10^8$.

The remark made concerning the part played by the symmetry of the active elements with respect to the z axis is consequently confirmed, since the spatial resolution is less good than in the case of FIGS. 6 and 7. On the other hand, there is a better gain.

Another important and surprising observation has been made. The proposed structures are distributed along the x axis, but are continuous along the y axis. One would consequently expect to have no locating of electrons in the direction of the y axis. In actual fact, a spatial resolution is obtained in the y direction practically equivalent to that of the x direction; consequently, it is the same in all the directions of the plane of the photocathode. This remarkable property is thought to be due to the curvature of the electron paths because of the magnetic field applied.

The following explanations have been developed in connection with the structures of FIGS. 6 to 8:

FIG. 6

If a primary electron strikes the grid 61, the secondary electrons thus produced have to pass between the bars of the grid 62 to reach one or other of the grids 63 and 64, and so on, taking into account the dimensions of the geometry of the structure. It can be said, then, that the paths of electrons issued from the grid 61 form a node between the bars of the grid 62.

FIG. 7

The paths of the secondary electrons issued from the grid 71 form a first node at the level of the grid 72 (z=2.5 mm), between its bars. They form a second node for z=10.5 mm, say slightly below the grid 75. The two nodes are substantially aligned with the emission point in the z direction, and the electrons then have the greatest chance of touching the grid 76 or another of the consecutive grids forming the next stage, while avoiding the grids 72 to 75.

FIG. 8

The paths are more complex, because of the less good uniformity of the electric field, due to the asymmetry of the plates with respect to the z axis.

However, it seems that conditions with regard to the nodes of the paths are comparable to those of the structure illustrated in FIG. 7.

In all cases, the realisation of these conditions of the path nodes, here called "helicoidal focusing", continues in the relationship between the electric and magnetic fields, taking into account the geometry of the structure and its dimensions. It is this helicoidal focusing which contributes the property of locating of electron paths, that is to say good spatial resolution in the xy plane. In this connection, it was observed that if the electric and magnetic fields are both multiplied by a factor K, while the dimensions of the structure and the time are divided by the same factor K, the equation of the electron movement remains unchanged.

Of course, the finer the grids, the better the spatial resolution, the electric and magnetic fields being consequently then increased.

It was also observed that the electron multipliers according to the invention have a better time resolution than shutter-type photomultipliers, their rise time being able to fall at least by 2 nanoseconds (10 to 90% of the peak current) from about 10 nanoseconds for most conventional photomultipliers with Venetian dynodes.

It was further observed that the electron multipliers are less subject to problems of space charge in the last stages than those of the prior technique. In fact, they present a better linearity of gain as a function of the current of electrons, relating to photomultipliers with Venetian dynodes, if not to those called "box-type".

These repercussions of the structures described above themselves also constitute important advantages of the present invention, which can be used independently of locating.

The invention essentially provides an electron multiplier tube capable of location, that is to say in which a fine correspondence exists between the departure points of electrons on the input surface of the tube and the arrival points of electrons at the output surface of the tube. The fineness of this correspondence is defined by the spatial resolution.

The application currently preferred is that of photomultipliers, the input surface then being a photocathode. However, the invention can be applied with all sorts of cathode emitting electrons selectively on their surface (for example, divided cathode). Furthermore, electrons produced by another source (electron accelerator, for example) can be injected through the input surface of the tube. The term "electron-emitting surface" here covers all these situations.

The output surface of the tube, or "electron-receiving surface", must of course allow selective detection of electrons according to their arrival point. The simplest embodiment is an anode divided into fragments, provided with individual electrical connections. The "coarse" spatial resolution thus allowed (for example, $\Delta x = \pm 2$ mm) is naturally limited by the dimensions of the anode fragments. This coarse spatial resolution can be substantially improved if the signals originating from different anode fragments are processed, the processing comprising amplitude analysis of the signals issued by several adjacent anode fragments. After processing, a resolution of ±0.1 mm is obtained from a coarse resolution $\Delta x = \pm 2$ mm, and for a dimension of anode fragments of the same order of size as this coarse resolution.

An additional and very important characteristic of the apparatus proposed is that the resolution is independent of statistical fluctuation due to the quantum yield of the photocathode, since all the adjacent anode fragments have a common photoelectron source. The resolution is consequently practically independent of the luminous intensity of the source analysed.

Another type of sensitive surface applicable instead of anode fragments in the electroluminescent screen, similar to cathode ray tube screens, which allows visual and/or photographic examination. The electron-receiving surface can be further embodied as in television camera tubes, and comprised of a mosaic of small elements which are charged under the effect of electrons received, while a beam of analysing electrons scans this surface so as to read the charge of each element of the mosaic. A sequential signal is thus obtained which, related to the scanning, defines the spatial distribution of the electrons received. Because of the sequential scanning, this type of receiving surface does not allow full benefit to be obtained from the time resolution of the tube according to the invention.

The electron multiplier according to the invention is capable of many applications: direct detection of electrons, and of photons (multi-photomultiplier), high gain image amplifier; the field of application is vast and particularly includes the detection of particles in nuclear physics and high energy physics, medicine, etc.

More precisely, a photomultiplier according to the invention, 100 mm in diameter, would replace 50 to 100 conventional small photomultipliers with Venetian dynodes by offering an excellent spatial resolution (±1.5 mm), a gain which is practically as good and more uniform and linear, and a higher time resolution.

The present invention is, of course, not limited to the embodiments described, and extends to any variant conforming to its spirit. For example, plates with the geometry of FIG. 6, or cylindrical bars with the geometries of FIGS. 6 and 7 can be used. Simple variations of the right-angled isosceles triangle cross-section, for example by making their hypotenuse curvilinear and concave can be envisaged.

On the other hand, it seems important to retain an arrangement in which each dynode stage is constituted by several levels, displaced from each other so as to constitute together a practically opaque structure for incident electrons.

We claim:

1. In an electron multiplier apparatus, comprising (1) a vacuum enclosure, (2) a plurality of dynode stages, each capable of secondary electron emission when hit by charged particles, each dynode stage having a distributed structure, (3) electron-receiving means, (4) means for producing an electron accelerating electric field generally oriented along a principal axis passing through said plurality of dynode stages, towards said electron-receiving means, (5) means for producing a magnetic field generally oriented along said principal axis, the improvement comprising, (a) said dynode stages each comprising at least two levels of distributed dynode elements, (b) said dynode levels being spaced apart along said principal axis, the dynode elements of each dynode level being shifted between themselves within each dynode stage to thereby define a substantially impervious wall against substantially rectilineal motions of electrons moving parallel to said principal axis, (c) the dynode elements in each level having a dimension transverse to said principal axis being selected in relationship with the magnetic field such that the average radius of curvature of secondary electrons emitted therefrom is at least equal to said transverse dimension of the dynode elements, (d) the dynode levels being so spaced along said principal axis that substantially no secondary electron emitted from the first dynode level in any given dynode stage will strike the second dynode level in the same dynode stage, while substantially all these said secondary electrons strike a dynode level of the next dynode stage.

2. Apparatus as claimed in claim 1, wherein the path of said secondary electron forms a node at the said second dynode level.

3. Electron multiplier apparatus as claimed in claim 1, wherein said dynode stages comprise grids of parallel bars, each grid being substantially perpendicular to the said principal axis.

4. Electron multiplier apparatus as claimed in claim 3, wherein the small dimension of each of said bars in the plane perpendicular to the principal axis is less than about 1 mm, and that the distance between two adjacent bars is at least equal to their small dimension.

5. Electron multiplier apparatus as claimed in claim 4, wherein the electric field is greater than 200 V/cm, and the magnetic field is greater than 50 Gauss.

6. Electron multiplier apparatus as claimed in claim 5, wherein the small dimension of each of the bars is about 0.5 mm, and the electron field and the magnetic field are selected correlatively to each other between about 400 and 1,000 V/cm, and about 100 to 500 Gauss respectively.

7. Electron multiplier apparatus as claimed in claim 3, wherein each dynode stage comprises two grids of bars spaced along the principal axis, in each grid the bars are spaced by a distance equal to their small dimension, the two grids are displaced with respect to each other by a distance equal to their small dimension, and the electric and magnetic fields are correlatively selected so that a secondary electron emitted by one bar of the first grid statistically always passes between the bars of the second grid.

8. Electron multiplier apparatus as claimed in claim 3, wherein each dynode stage comprises n grids of bars spaced along the principal axis, in each grid the bars are spaced by n times their small dimension, the n grids are successively displaced in the same direction by a distance equal to their small dimension, each with respect to the preceding one, and the electric and magnetic fields are correlatively selected so that a secondary electron emitted by one bar of one grid on a parallel to the principal axis statistically passes over the same parallel substantially to the levels of the next gate and the n-th grid.

9. Electron multiplier apparatus as claimed in claim 8, wherein $n=5$.

10. Electron multiplier apparatus as claimed in claim 8, wherein the bars have a cross-section which is symmetrical with respect to a plane passing through the principal axis of the tube and the axis of their largest dimension.

11. Electron multiplier apparatus as claimed in claim 3, wherein the cross-section of the bars is of the right-angled isosceles triangular type with the apx of the two equal legs directed towards the upstream side of the electron paths, or of the circular type, or of the flat rectangular type with predetermined angle of inclination to the principal axis, the bars then being plates.

12. Electron multiplier apparatus as claimed in claim 1, comprising an electron-emissive cathode for producing primary electrons towards said dynode stages.

13. Electron multiplier apparatus as claimed in claim 12, wherein said cathode is a photocathode.

14. Electron multiplier apparatus as claimed in claim 1, comprising means for passing charged particles originated from another portion of the enclosure towards said dynode stages.

* * * * *